US011884439B2

(12) United States Patent
Zeitz

(10) Patent No.: US 11,884,439 B2
(45) Date of Patent: Jan. 30, 2024

(54) PLASTIC BAG DISPENSER DEVICE

(71) Applicant: Jeffrey Zeitz, Los Angeles, CA (US)

(72) Inventor: Jeffrey Zeitz, Los Angeles, CA (US)

( * ) Notice: Subject to any disclaimer, the term of this patent is extended or adjusted under 35 U.S.C. 154(b) by 193 days.

(21) Appl. No.: 17/590,593

(22) Filed: Feb. 1, 2022

(65) Prior Publication Data

US 2023/0242298 A1 Aug. 3, 2023

(51) Int. Cl.

| | |
|---|---|
| ***B65B 67/12*** | (2006.01) |
| ***B65D 25/52*** | (2006.01) |
| ***B65D 83/08*** | (2006.01) |
| ***B65D 51/28*** | (2006.01) |
| ***A45F 5/02*** | (2006.01) |
| ***E01H 1/12*** | (2006.01) |

(52) U.S. Cl.

CPC ..... *B65B 67/1266* (2013.01); *B65D 25/52* (2013.01); *B65D 51/28* (2013.01); *B65D 83/0805* (2013.01); *A45F 5/02* (2013.01); *B65B 2067/1272* (2013.01); *E01H 2001/128* (2013.01)

(58) Field of Classification Search

CPC ..... B65B 67/1266; B65B 2067/1272; B65D 25/52; B65D 51/28; B65D 83/0805; A45F 5/02; E01H 2001/128

USPC ..... 222/173

See application file for complete search history.

(56) References Cited

U.S. PATENT DOCUMENTS

| | | | | |
|---|---|---|---|---|
| 4,953,815 | A | 9/1990 | Beymer | |
| 5,921,512 | A * | 7/1999 | Torres | B65B 43/14 248/99 |
| 6,223,695 | B1 | 5/2001 | Edwards | |
| 8,720,384 | B2 * | 5/2014 | Gee | A45C 11/00 294/1.3 |
| 9,491,932 | B1 * | 11/2016 | Becattini, Jr. | B65D 25/22 |
| 9,975,660 | B2 | 5/2018 | Cartledge | |
| D862,006 | S * | 10/2019 | Axelrod | D30/153 |
| 10,492,472 | B1 * | 12/2019 | Moloznik | A01K 27/008 |
| D917,884 | S | 5/2021 | Seeger | |
| 2003/0202838 | A1 * | 10/2003 | Sun | A45D 34/042 401/196 |
| 2006/0125255 | A1 * | 6/2006 | Bell | E01H 1/1206 294/1.3 |
| 2006/0231043 | A1 | 10/2006 | Galdo | |
| 2007/0251466 | A1 * | 11/2007 | Bell | E01H 1/1206 119/867 |
| 2008/0179902 | A1 * | 7/2008 | Phillips | E01H 1/1206 294/1.3 |

(Continued)

FOREIGN PATENT DOCUMENTS

| | | |
|---|---|---|
| WO | WO2016059379 | 4/2016 |

*Primary Examiner* — Paul R Durand
*Assistant Examiner* — Michael J. Melaragno

(57) ABSTRACT

A plastic bag dispenser device for dispensing feces bags with help from a moisture pad includes a tube. The tube has an aperture positioned on the side of the tube. The aperture provides an opening for a user to grab a canine feces bag. A lid is positioned on top of the tube. A compartment is attached to the top of the lid. The compartment defines a space for a moisture pad to be placed. The moisture pad wets the fingers of the user. A roll of bags is stored within the hollow interior of the tube. Each of the bags is coupled to each other by a perforation line. The user can separate each bag from the roll by pulling the bag from the perforation line. A snap hook clip is attached to the exterior of the tube and is used for attaching the tube to a canine leash.

14 Claims, 4 Drawing Sheets

(56) References Cited

U.S. PATENT DOCUMENTS

| | | | | |
|---|---|---|---|---|
| 2008/0185854 | A1* | 8/2008 | Bell | E01H 1/1206 294/1.3 |
| 2009/0267370 | A1* | 10/2009 | Bell | E01H 1/1206 294/1.3 |
| 2010/0116857 | A1 | 5/2010 | Vickers | |
| 2011/0210571 | A1* | 9/2011 | Dan | A41D 19/0024 294/1.3 |
| 2012/0286003 | A1* | 11/2012 | Shadday | E01H 1/1206 206/229 |
| 2013/0125834 | A1* | 5/2013 | Gee | B65D 11/20 220/524 |
| 2015/0164286 | A1* | 6/2015 | Pelfrey | A47K 7/03 222/173 |
| 2015/0167265 | A1* | 6/2015 | Becattini, Jr. | A01K 1/0114 294/1.3 |
| 2018/0220624 | A1* | 8/2018 | Bussell | A01K 23/005 |
| 2019/0261765 | A1 | 8/2019 | Alonzo | |
| 2019/0282039 | A1* | 9/2019 | Lewis | A45D 34/00 |
| 2020/0332485 | A1 | 10/2020 | Garland | |
| 2020/0399023 | A1* | 12/2020 | Buzot | A45D 34/02 |
| 2022/0047059 | A1* | 2/2022 | Romiti | A45D 33/33 |
| 2023/0242298 | A1* | 8/2023 | Zeitz | B65D 25/52 119/161 |
| 2023/0255413 | A1* | 8/2023 | Campbell | A47K 10/3827 242/588.3 |

* cited by examiner

PLASTIC BAG DISPENSER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to canine feces bag containers and more particularly pertains to a new canine feces bag container for dispensing feces bags with help from a moisture pad.

(2) Description of Related Art Including Information Disclosed Under 37 CFR 1.97 and 1.98

The prior art relates to canine feces bag containers. The prior art includes a variety of plastic bag containers being portable and having a moisture attachment. Known prior art lacks a plastic bag container designed for holding canine feces bags and having a moisture attachment with a leash clip coupled to the container.

BRIEF SUMMARY OF THE INVENTION

An embodiment of the disclosure meets the needs presented above by generally comprising a tube. The tube has a cylindrical body with a hollow interior. The space within the hollow interior defines a place for a roll of canine feces bags to be held. The tube has an aperture positioned on the side of the tube. The aperture has an oval shape and provides an opening for a user to grab a canine feces bag. A lid is positioned on top of the tube. The lid engages by threading to the top of the tube. A compartment is attached to the top of the lid. The compartment defines a space for a moisture pad to be placed. The moisture pad is configured for the user to wet their fingers when using the canine feces bag. A roll of bags is stored within the hollow interior of the tube. Each of the bags is coupled to each other by a perforation line. The user can separate each bag from the roll by pulling the bag from the perforation line. A snap hook clip is attached to the exterior of the tube by a locking ring. The snap hook clip is used for attaching the tube to a canine leash.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
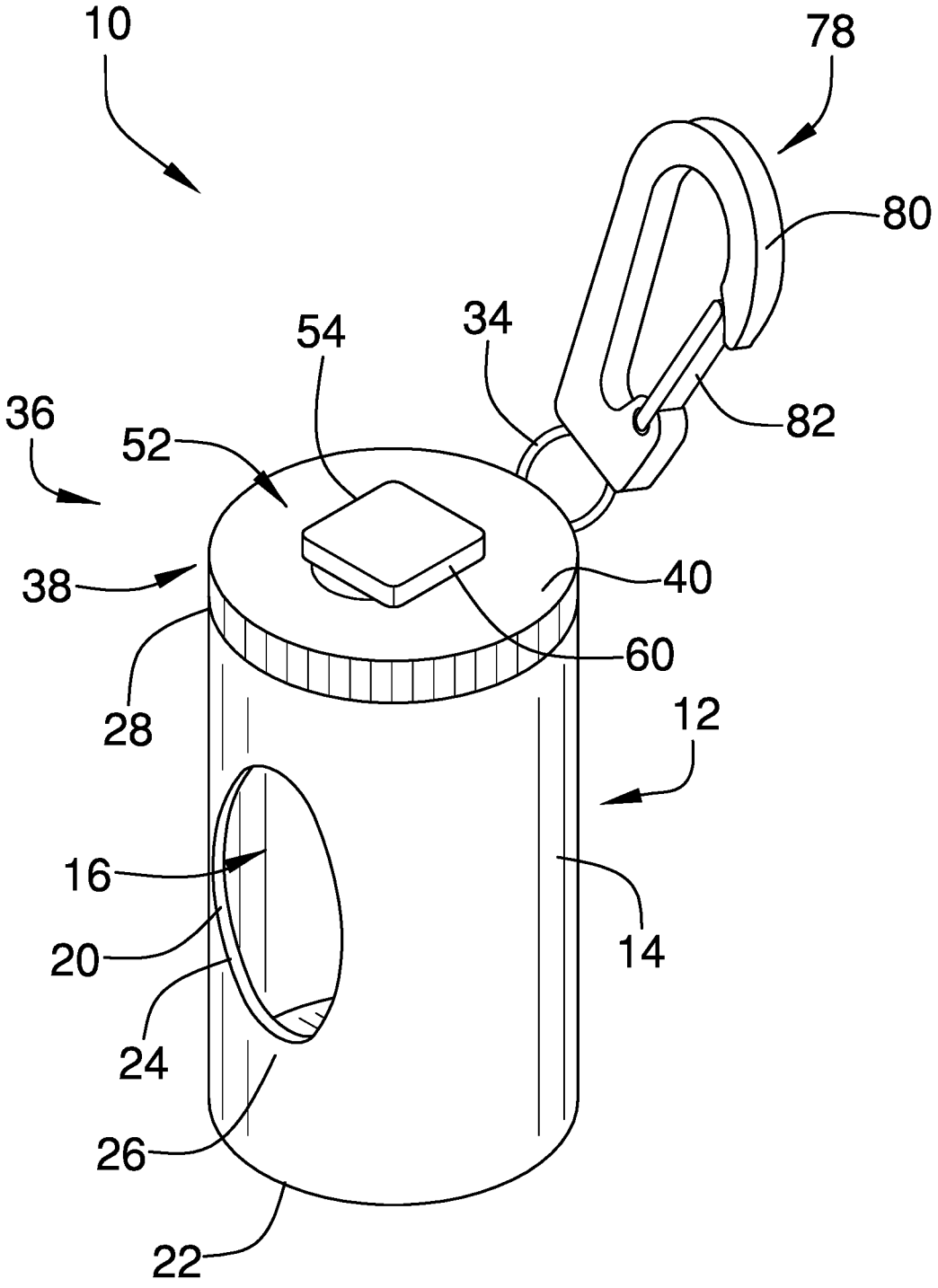
FIG. 1 is a front isometric view of a plastic bag dispenser device according to an embodiment of the disclosure.
Figure 2:
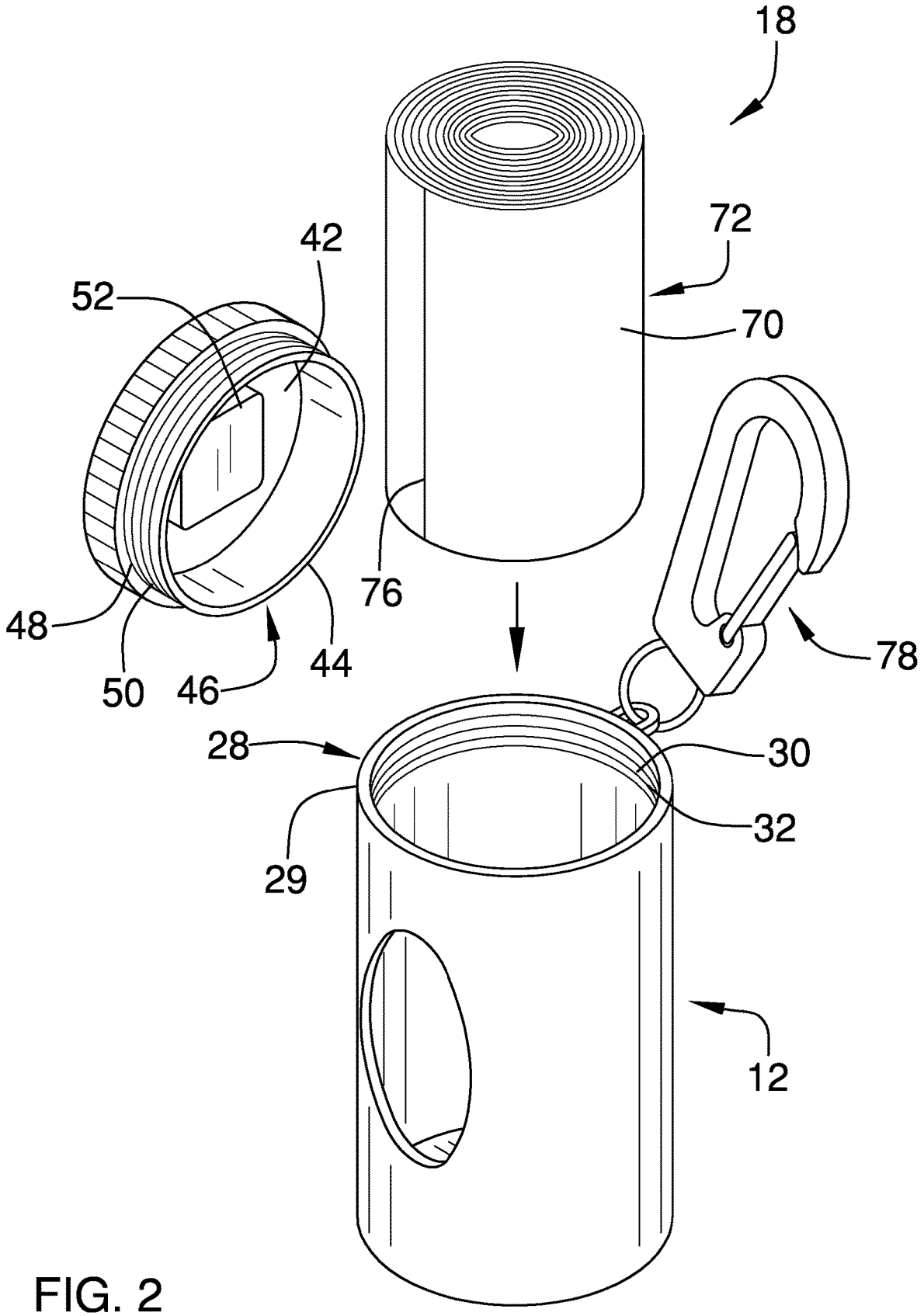
FIG. 2 is an exploded view of an embodiment of the disclosure.
Figure 3:
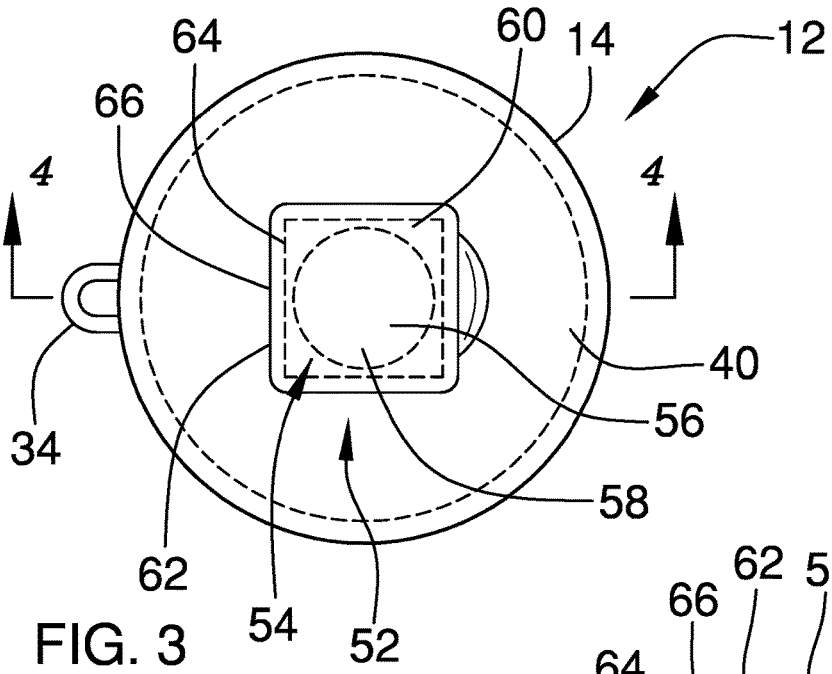
FIG. 3 is a top view of an embodiment of the disclosure.
Figure 4:
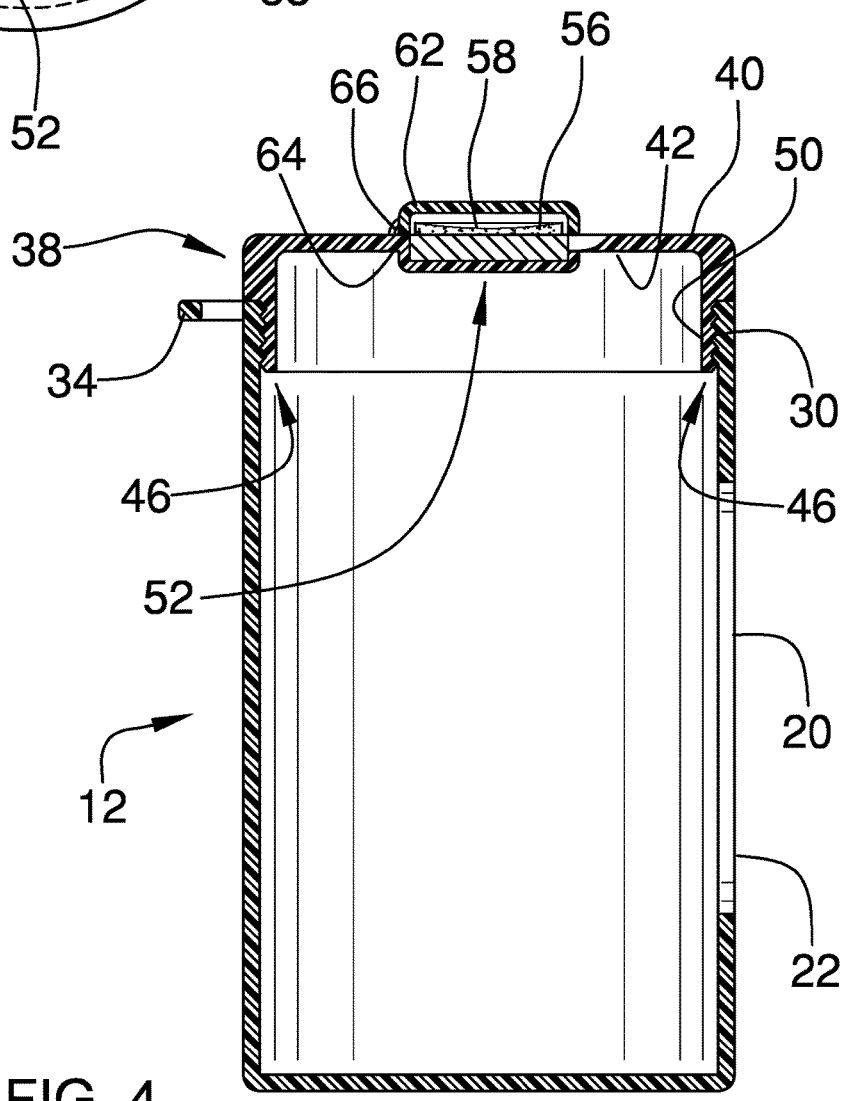
FIG. 4 is a cross-sectional view of an embodiment of the disclosure of line 4-4 from FIG. 3.
Figure 5:
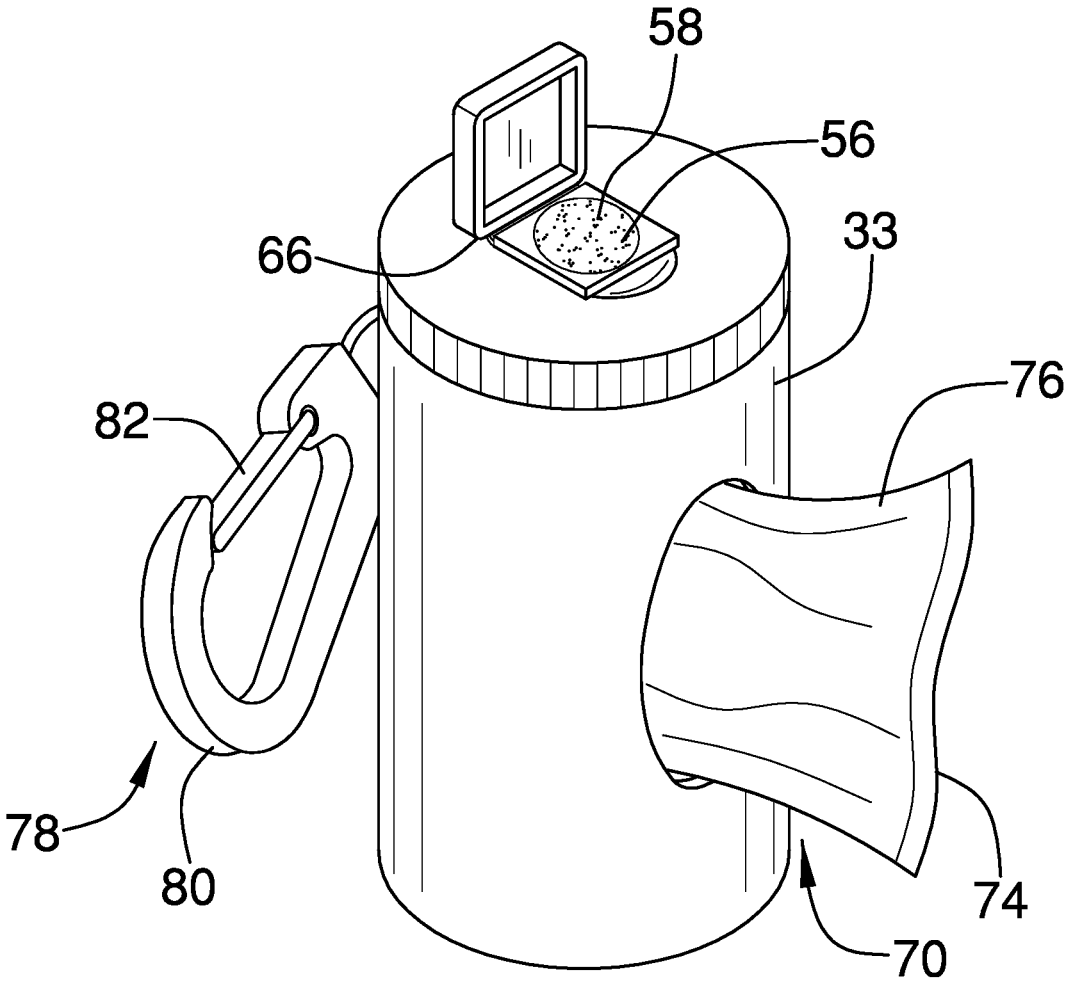
FIG. 5 is an in-use view of an embodiment of the disclosure.

With reference now to the drawings, and in particular to FIGS. 1 through 5 thereof, a new canine feces bag container embodying the principles and concepts of an embodiment of the disclosure and generally designated by the reference numeral 10 will be described.

As best illustrated in FIGS. 1 through 5, the plastic bag dispenser device 10 generally comprises a tube 12. The tube 12 has a cylindrical shaped body 14. The tube 12 has a hollow interior 16. The hollow interior 16 defines a space for a roll of canine feces bags 18 to be held. The tube 12 has an aperture 20. The aperture 20 is positioned on the side 22 of the tube 12. The aperture 20 has an oval shape 24. The longitudinal axis 26 of the aperture 20 is positioned upright relative to the tube 12. The aperture 20 is configured for being an opening for a user 11 to access the roll of canine feces bags 18.

An end 28 of the tube 12 is an open end. The end 28 of the tube 12 has threading 30. The threading 30 is positioned on an interior surface 32 of the tube 12. A locking ring 34 is coupled to an exterior surface 33 of the tube 12. The locking ring 34 is positioned proximate to the end 28 of the tube 12. The end 28 of the tube 12 provides an opening to the hollow interior 16 of the tube 12.

A lid 36 has a base 38. The base 38 has an upper surface 40 and a lower surface 42. A ring 44 is positioned on the lower surface 42. The ring 44 protrudes out from the lower surface 42 and defines a wall 46. An exterior surface 48 of the wall 46 has a threading 50. The threading 50 of the lid 36 is complementary to the threading 30 of the tube 12. The exterior surface 48 of the wall 46 engages by threading to the interior surface 32 of the tube 12. The purpose of the lid 36 is to enclose the roll of canine feces bags 18 within the hollow interior 16 of the tube 12.

A compartment 52 is positioned in a center 54 of the upper surface 40 of the lid 36. The compartment 52 defines a space for storing a tackifying pad 56. The tackifying pad 56 is a moisturized material 58. The tackifying pad 56 is configured for providing moisture to the fingers 13 of the user 11 when in physical contact. The compartment 52 has a door 60. An edge 62 of the door 60 is coupled to an edge 64 of the compartment 52. The coupling of the door 60 and the compartment 52 is configured for being a hinge 66 whereby the door 60 can be positioned open or closed.

The roll of canine feces bags 18 is positioned within the hollow interior 16 of the tube 12. The roll of canine feces bags 18 has a plurality of bags 70. Each of the canine feces bags 70 is a plastic material 72 and is configured for being used to hold canine feces for later disposal. Each of the canine feces bags 70 is coupled to each other by a perforation line 74. An end 76 of the roll of canine feces bags 18 is configured for being positioned within the aperture 20 of the tube 12.

A clip 78 is coupled to the locking ring 34 of the tube 12. The clip 78 is a snap hook 80 having a spring-loaded bar 82. The clip 78 has oriental movement while being coupled to the locking ring 34 of the tube 12. The clip 78 is configured for attaching the tube 12 to a canine leash.

In use, the end 76 of the roll of canine feces bags 18 is positioned in the aperture of the tube 12. The user 11 grabs the end 76 of the roll of canine feces bags 18 and detaches the end 76 from the roll of canine feces bags 18 by pulling the end 76 from the perforation line 74. The user 11 opens the door 60 of the compartment 52 to expose the tackifying pad 56. The fingers 13 of the user 11 physically contact the tackifying pad 56 to moisturize the fingers 13. The moisture on the fingers 13 is configured for enhancing the handling of each of the canine feces bags 18. The user 11 can attach the tube 12 to the canine leash by attaching the snap hook 80 to the canine leash. The spring-loaded bar 82 will retract when the clip 78 connects to the canine leash and the spring-loaded bar 82 snaps into a locked positioned 86 after connecting to the canine leash.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plastic bag dispenser device comprising:

a tube, said tube having a hollow interior, said hollow interior defining a space for a roll of canine feces bags to be held in, said tube having an aperture;

a lid, said lid having a base;

a tackifying pad, said tackifying pad positioned in a compartment, said compartment being coupled to a top surface of said base of said lid, said compartment having a space defined for holding said tackifying pad, said tackifying pad being configured for adding moisture to the fingers of the user; and a roll of bags, said roll of bags having a plurality of bags, each of said bags being coupled to each other by a perforation line, each of said bags being removable from said roll of bags by tearing at said perforation line.

2. The plastic bag dispenser device of claim 1, further comprising said tube having a cylindrical shape.

3. The plastic bag dispenser device of claim 1, further comprising said tube having an aperture, said aperture being an oval shape, said aperture being positioned on a side of said tube, said oval shape having a longitudinal axis positioned upright relative to said tube.

4. The plastic bag dispenser device of claim 1, further comprising an end of said tube having threading, said threading being positioned on an interior surface of said tube, a locking ring is coupled to an exterior surface of said tube.

5. The plastic bag dispenser device of claim 1, further comprising said base of said lid being circular.

6. The plastic bag dispenser device of claim 1, further comprising said base having a ring, said ring being positioned on a perimeter of said base, said ring protruding out from said base.

7. The plastic bag dispenser device of claim 1, further comprising said lid having threading, said threading being positioned on an exterior surface of said ring, said threading of said tube being complementary to said threading of said lid whereby said lid engages by threading to said tube.

8. The plastic bag dispenser device of claim 1, further comprising said tackifying pad being a moisturized material.

9. The plastic bag dispenser device of claim 1, further comprising said compartment having a door, said compartment having a space defined for holding said tackifying pad.

10. The plastic bag dispenser device of claim 1, further comprising said tackifying pad being replaceable.

11. The plastic bag dispenser device of claim 1, further comprising said bags being plastic.

12. The plastic bag dispenser device of claim 1, further comprising a clip, said clip being a snap hook, said ring having a spring-loaded bar, said spring loaded bar being configured for opening and closing to secure said clip to a leash.

13. The plastic bag dispenser device of claim 12, further comprising said clip being coupled with said locking ring of said tube.

14. A plastic bag dispenser device comprising:

a tube, said tube having a cylindrical shape, said tube having a hollow interior, said hollow interior defining a space for a roll of canine feces bags to be held in, said tube having an aperture, said aperture being an oval shape, said aperture being positioned on a side of said tube, said oval shape having a longitudinal axis positioned upright relative to said tube, and end of said tube being open, said end of said tube having threading, said threading being positioned on an interior surface of said tube, a locking ring is coupled to an exterior surface of said tube;

a lid, said lid having a base, said base being circular, said base having a ring, said ring being positioned on a perimeter of said base, said ring protruding out from said base, said lid having threading, said threading being positioned on an exterior surface of said ring, said threading of said tube being complementary to said threading of said lid whereby said lid engaging by threading to said tube;

a tackifying pad, said tackifying pad being a mildly moisturized material, said tackifying pad positioned in a compartment, said compartment being coupled to a top surface of said base of said lid, said compartment having a door, said compartment having a space defined for holding said tackifying pad, said tackifying pad being replaceable, said tackifying pad being configured for adding moisture to the fingers of the user;

a roll of bags, said roll of bags having a plurality of bags, said bags being plastic, each of said bags being coupled to each other by perforation, each of said bags being removable from said roll of bags by tearing at the perforation line; and a clip, said clip being a snap hook, said ring having a spring-loaded bar, said spring loaded bar being configured for opening and closing to secure said clip to a leash, said clip being coupled with said locking ring of said tube.

* * * * *